US005862565A

United States Patent [19]

Lundstedt

[11] Patent Number: 5,862,565

[45] Date of Patent: Jan. 26, 1999

[54] APPARATUS FOR CLEANING OR SCRUBBING

[76] Inventor: Kurt Lundstedt, 20 Pheasant Run Rd., Hawthorne Woods, Ill. 60047

[21] Appl. No.: 969,687

[22] Filed: Nov. 13, 1997

[51] Int. Cl.[6] ..... A47L 1/15

[52] U.S. Cl. ..... 15/220.1; 15/144.1; 15/144.2; 15/209.1; 15/228

[58] Field of Search ..... 15/144.1, 144.2, 15/209.1, 220.1, 228, 231, 232, 244.2

[56] References Cited

U.S. PATENT DOCUMENTS

| | | | |
|---|---|---|---|
| 2,304,127 | 12/1942 | Stetson | 15/231 |
| 2,509,687 | 5/1950 | Lee | 15/144.1 X |
| 2,532,979 | 12/1950 | Wilson | 15/144.1 X |
| 3,224,025 | 12/1965 | Altrock | 15/144.2 X |
| 3,820,187 | 6/1974 | Numbers et al. | 15/144.2 X |
| 4,852,210 | 8/1989 | Krajicek | 15/231 X |
| 5,379,478 | 1/1995 | Vosbikian | 15/144.1 X |
| 5,596,787 | 1/1997 | Stevens et al. | 15/144.2 X |

FOREIGN PATENT DOCUMENTS

| | | | |
|---|---|---|---|
| 846413 | 8/1960 | United Kingdom | 15/144.1 |

*Primary Examiner*—Mark Spisich
*Attorney, Agent, or Firm*—Niro, Scavone, Haller & Niro

[57] ABSTRACT

A cleaning device having a handle that is connected to a cleaning head having a cleaning pad by the use of a spindle that is connected to the handle by an axle that permits the cleaning head to pivot on the axle. In addition, the spindle is enclosed in a spindle housing that permits the rotational movement of the cleaning head.

13 Claims, 3 Drawing Sheets

APPARATUS FOR CLEANING OR SCRUBBING

BACKGROUND OF THE INVENTION

The present invention relates to a cleaning and scrubbing apparatus that provides access to surfaces that are difficult to reach.

SUMMARY OF THE INVENTION

Although there exists many types of hand held cleaning and scrubbing devices, (i.e. Dust Mops, Squeegees, Scrub Brushes and Wet Mops), none are particularly well suited for use on generally vertical or slanted surfaces. In particular, due to their construction and required method of use, none are well suited for interior windows that are commonly found on land based vehicles (i.e. automobiles, trucks, tractors, and recreational vehicles), those found on water based vehicles, and irregularly shaped building windows.

Accordingly, it would be advantageous to provide a hand held apparatus that allowed cleaning access to the above mentioned surfaces. Such an apparatus would be particularly useful in fully accessing the interior windshield surfaces of various vehicles to remove film build up caused by the out-gassing of plastics used in vehicle interiors and the film caused by smoking.

Presently, adequately accessing these confined surfaces by hand is difficult due to the slope of the windows and the obstacles (i.e. steering wheels, dash broad, and mirrors) that obstruct and inhibit motion. Further, it would be useful if such an apparatus had a means of quickly replacing its cleaning surface when it becomes soiled or wet.

The present invention satisfies the above expressed needs by providing a planer cleaning head, a universal swiveling connector, and a tubular handle. More specifically, in one embodiment the head is generally diamond shaped to facilitate access to small angular areas of the surface to be cleaned and is made of sufficiently flexible material allowing conformance to concave surfaces. The head also provides on one of its planer surfaces a material which is able to hold fast a replaceable cleaning pad. The head is connected to the handle via a swivel which allows the head to universally pivot in multiple directions and remain flat or tangent to the surface to be cleaned. Thus, a person using the apparatus can manipulate and direct the head on the surface and around obstacles by twisting the handle and making sweeping motions.

DESCRIPTION OF THE PREFERRED EMBODIMENT

Figure 1:
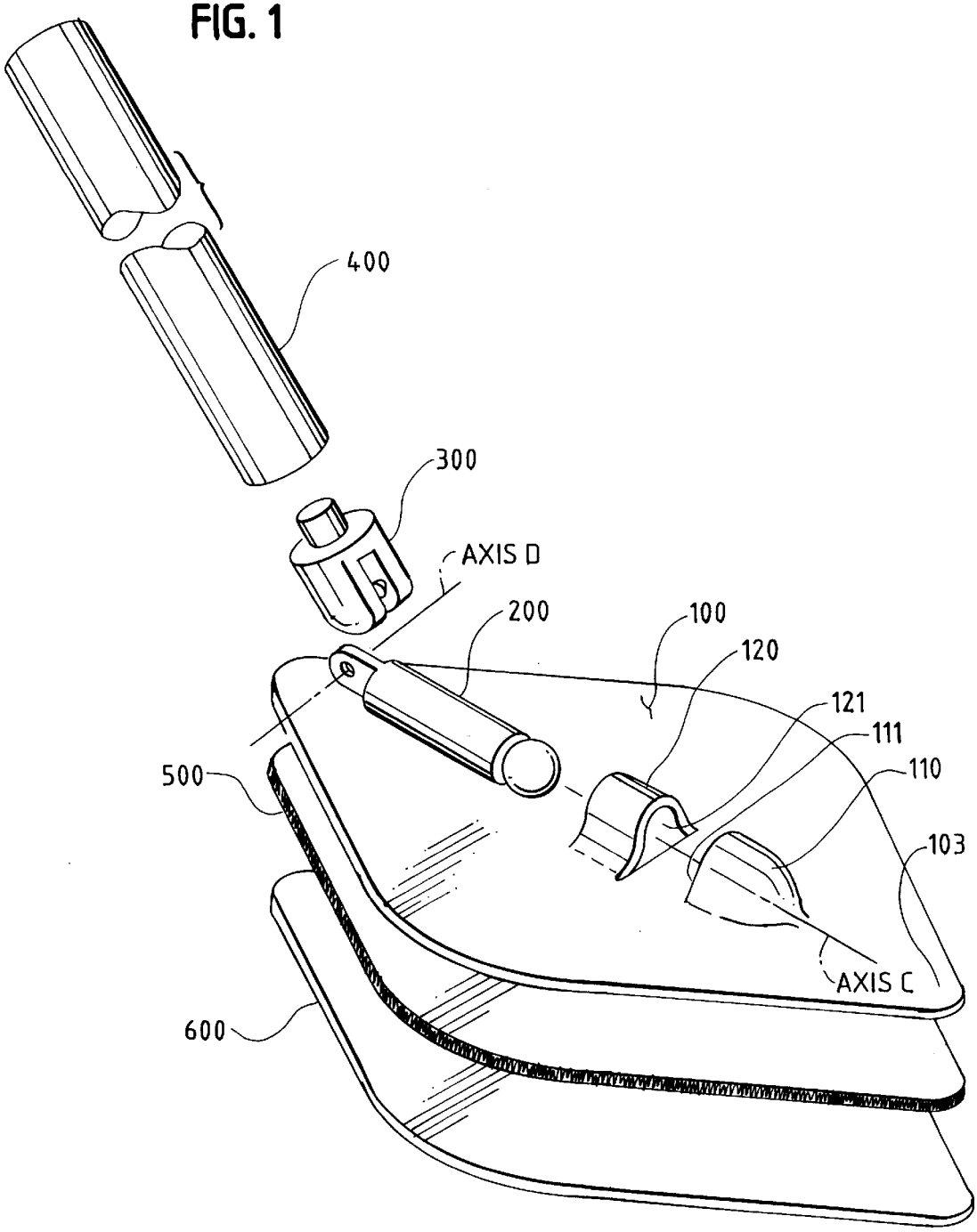
FIG. 1 is a exploded perspective view of an embodiment of the present invention.

Referring to FIG. 1, the preferred construction of the present invention includes a generally planer and diamond shaped head 100, a cylindrical spindle connector 200, a pivoting connector 300, a tubular handle 400, a fastening material 500, and a cleaning material 600.

Figure 2:
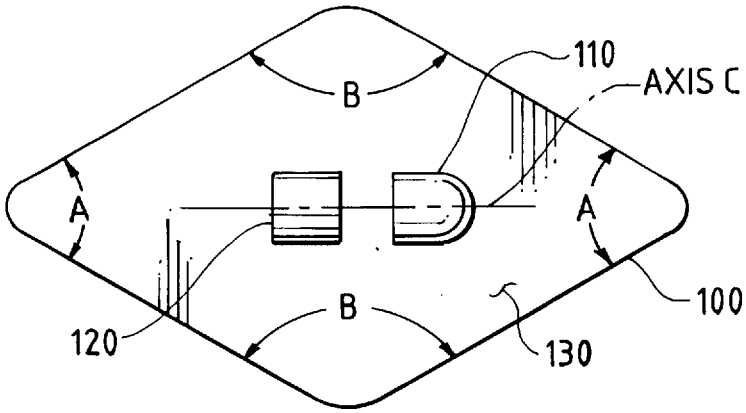
FIG. 2 is a plan view of the planer cleaning head shown in FIG. 1.

Referring to FIG. 2 of the cleaning head it can be seen that the planer head is generally diamond shaped but any shape in which a portion of the head forms an apex would be suitable for use with the present invention. For example, another suitable shape would be a tear-drop configuration. It has two angles A and B which correspond to the acute and obtuse angles of the diamond shape respectively. The apex 103 formed by one of the acute angles allows the head to extend into small angular areas of a surface to be cleaned. Arch shaped spindle housings 110 and 120 are formed on the surface 130 of the cleaning head for receiving the cylindrical spindle 200 and define generally circular apertures 111 and 121, respectively.

Figure 3:
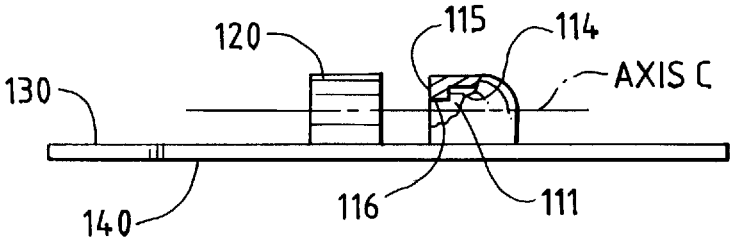
FIG. 3 is a side elevation view with portions removed of the planer cleaning head shown in FIG. 1.
Figure 4:
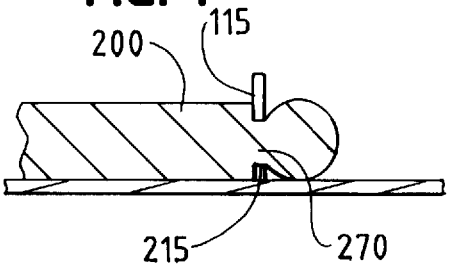
FIG. 4 is an exploded cross sectional view of the cylindrical spindle according to an embodiment of the present invention.

The spindle housings 110 and 120 are aligned along an axis C which bisects acute angles A and apex 103. As shown in FIGS. 3 and 4, the interior of spindle housing 110 includes a generally perpendicular edge 115. Even though two spindle housings are shown, a single elongated housing could be used. The preferred construction material of head 100 and the components thereon may be a resilient type of plastic or the like which would offer flexibility to the planer surface to conform to various concave surfaces.

Figure 5:
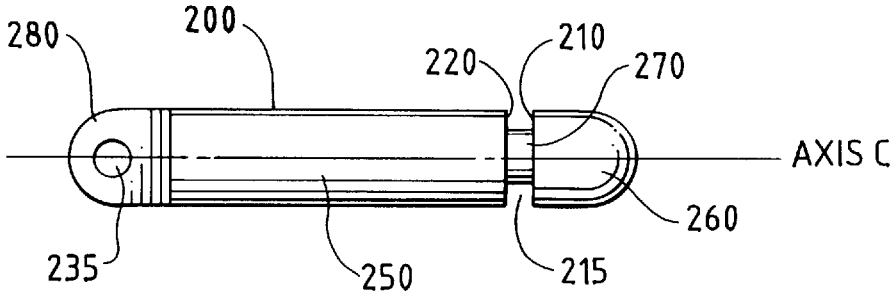
FIG. 5 is a side view of the cylindrical spindle shown in FIG. 4.

As shown in FIGS. 4 and FIG. 5, cylindrical spindle connector 200 includes a main section 250, neck section 270, distal end 260, and a recessed annular groove 215 formed by generally parallel surfaces 210 and 220. A planar proximal end 280 having an aperture 235 that extends entirely through proximal end 280. When spindle 200 is inserted into the spindle housings 110 and 120 it is allowed to rotate about axis C but is held fixedly engaged by the cooperation of edge 115 in housing 110 and spindle surfaces 210 and 220 respectively through the action of having edge 115 seat itself within annular groove 215 once spindle 200 is inserted into housing 110.

Figure 6:
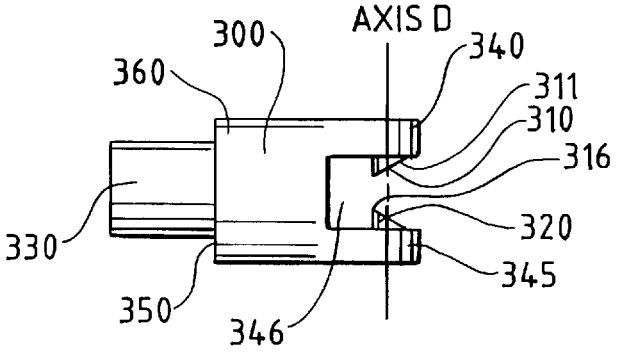
FIG. 6 is a plan view of the pivoting connector according to an embodiment of the present invention.

FIG. 6 depicts a second pivoting connector 300 with a cylindrical boss section 330 which extends from end surface 350 and a U shaped section that is formed by base section 360 and leg sections 340 and 345. Formed on the interior surfaces of leg sections 340 and 345 is an axle 346 formed by retaining lugs 310 and 320 which are opposingly located. Retaining lugs 310 and 320 have sloped surfaces 311 and 316 to allow easy assembly to the spindle connector 200. Assembly may also be facilitated by making second pivoting connector 300 from a sufficiently resilient material to allow leg sections 340 and 345 to flex outward until retaining lugs 310 and 320 drop into hole 235 of spindle connector 200. This cooperation between hole 235 and retaining lugs 310 and 320 allows the second pivoting connector to pivot freely about Axis D while being fixedly engaged to the spindle connector 200. The boss section 330 is of an appropriate size to be frictionally engaged into the tubular handle 400.

Referring back to FIG. 1, the present invention also includes a cleaning pad material 600 and a cleaning pad retaining material 500 which are roughly the same shape as cleaning head 100. Preferably the retaining material 500 is of the pressure sensitive type or "hook" material found in hook and loop fastening products (e.g. Velcro). The material 500 is fixed to the cleaning head 100 to surface 140 as shown in FIG. 3 preferably through use of pressure sensitive adhesive. Cleaning material 600 can be of a wide variety of compositions ranging from natural fiber woven cloth (i.e. cotton) to non-woven synthetic fiber (i.e. polyester) that have some adhesion to the retaining material 500.

In use, the invention's ability to rotate about axis C through the rotation of spindle 200 within housings 110 and 120 allows the user to maintain cleaning material 600 in contact with the surface to cleaned while performing back and forth or sweeping cleaning strokes. Moreover, second pivoting connector allows cleaning head to be pivoted about axis D through the rotation about axle 346. This is beneficial since it extends the reach of the device by wing handle 400 to reach areas which require that the handle be positioned in the same horizontal plane as cleaning head 100. It should be understood that various changes and modifications to the erred embodiment described would be apparent to those skilled in the art. Changes and modifications can be made without departing from the spirit and scope of the present invention and out diminishing its intended advantages. It is, therefore, intended that such changes and modifications be covered by the following claims.

What is claimed is:

1. A cleaning device comprising:

a handle having a connector located at one end of said handle;

a cleaning head having opposing sides that form a base portion and that also converge to form a distally located apex, said cleaning head further having first and second planar surfaces;

at least one spindle housing located along an axis that bisects said apex on said first surface, said spindle housing defines a generally circular aperture;

a cylindrical spindle having a distal end and a proximal end, said distal end of said spindle is adapted to be insertable into said spindle housing;

said spindle housing securingly retains said spindle and permits said spindle to rotate within said spindle housing;

said connector attachable to said proximal end of said spindle, said attachment of said connector and said proximal end of said spindle forms an articulating joint that permits said handle to pivot with respect to said spindle; and a cleaning pad affixed to said second surface of said cleaning head.

2. The device of claim 1 wherein said articulating joint permits said handle to rotate from a horizontal position with respect to said first planar surface to a position that exceeds 90 degrees with respect to said first planar surface.

3. The device of claim 1 wherein said cleaning head is diamond shaped.

4. The device of claim 1 wherein said cleaning head is teardrop shaped.

5. The device of claim 1 wherein said cleaning pad is releasably affixed to said second planar surface of said cleaning head.

6. The device of claim 1 wherein said distal end of said spindle includes an annular groove and said spindle housing includes a stop that seats within said annular groove to retain said spindle within said spindle housing while permitting the rotational movement of said spindle within said spindle housing.

7. A cleaning device comprising:

a handle having a connector located at one end of said handle, said connector having two opposingly located legs that define a gap and an axle which is located between said legs and within said gap;

a cleaning head having opposing sides that form a base portion and that also converge to form a distally located apex, said cleaning head further having first and second planar surfaces;

at least one spindle housing located along an axis that bisects said apex on said first surface, said spindle housing defines a generally circular aperture;

a cylindrical spindle having a distal end and a proximal end, said distal end of said spindle is adapted to be insertable into said spindle housing whereby said spindle is securingly retained within said spindle housing;

said proximal end of said spindle adapted to fit within said gap of said connector and includes an aperture that is sized to fit around said axle;

said cleaning head is attached to said handle by positioning said axle within said aperture on said spindle; and a cleaning pad located on said second planar surface of said cleaning head.

8. The device of claim 7 said axle is comprised of two oppossingly located lugs, each of said lugs is located on each of said legs and extends inwardly towards said gap.

9. The device of claim 8 wherein the face of each of said lugs angles inwardly to facilitate the insertion of said proximal end of said spindle into said gap.

10. The device of claim 7 wherein each of said legs has a planar surface that forms a gap having planar walls and said proximal end of said spindle is configured to mate with said gap.

11. The device of claim 7 wherein said cleaning head is diamond shaped.

12. The device of claim 7 wherein said cleaning head is tear-drop shaped.

13. The device of claim 7 wherein said distal end of said spindle includes an annular groove and said spindle housing includes a stop that seats within said annular groove to retain said spindle within said spindle housing while permitting the rotational movement of said spindle within said housing.

* * * * *